US005279419A

United States Patent [19]

Eggers

[11] Patent Number: 5,279,419

[45] Date of Patent: Jan. 18, 1994

[54] CARDBOARD TRAY FOR CYLINDRICAL PACKS

[76] Inventor: Thies Eggers, 5253 Lindlar/Schmitzhöhe, Reichenhain 21, Fed. Rep. of Germany

[21] Appl. No.: 856,224

[22] PCT Filed: Sep. 19, 1990

[86] PCT No.: PCT/EP90/01592

§ 371 Date: May 12, 1992

§ 102(e) Date: May 12, 1992

[87] PCT Pub. No.: WO92/05086

PCT Pub. Date: Apr. 2, 1992

[51] Int. Cl.[5] ..... B65D 5/20

[52] U.S. Cl. ..... 206/446; 220/23.4; 220/509; 229/120.17

[58] Field of Search ..... 206/427, 562–565; 220/23.4, 509–513, 515, 518, 557; 229/120.17

[56] References Cited

U.S. PATENT DOCUMENTS 774,044 11/1904 Craw ..... 206/427
4,278,168 7/1981 Wood ..... 206/427
4,394,903 7/1983 Bakx ..... 206/427
4,398,631 8/1983 Graser ..... 206/427

FOREIGN PATENT DOCUMENTS 7919187 7/1979 Fed. Rep. of Germany ..... B65D 5/30
8629687 1/1987 Fed. Rep. of Germany ..... B65D 5/50
8905378 6/1989 Fed. Rep. of Germany ..... E65D 5/50

*Primary Examiner*—Jimmy G. Foster
*Attorney, Agent, or Firm*—Edwin D. Schindler

[57] ABSTRACT

A cardboard tray for cylindrical packs having a base section, parallel to the longitudinal edges of which are arranged receivers aligned in longitudinal rows for longitudinal rows of packs. The technical problem is to reduce the consumption of materials and to utilize the space better within a stack, as well as to improve the functional value of the cardboard trays. Adjacent longitudinal rows of receivers are displaced relative to one another. The transverse edges of the base section follow a meandering line, and the base section has cut-in border flanges which are bent up and joined.

9 Claims, 5 Drawing Sheets

2
7
7
8
1
10
7
3
8
4
2
9
5
6

CARDBOARD TRAY FOR CYLINDRICAL PACKS

TECHNICAL FIELD OF THE INVENTION

The invention relates to a cardboard tray for cylindrical packs having a base section, parallel to the longitudinal edges of which are arranged receivers aligned in longitudinal rows for longitudinal rows of packs. The field of application of the invention comprises beaker packs, such as yoghurt packs, drink packs, cans, jars or the like.

PRIOR ART

A cardboard tray of this type is known from DE-OS 36 37 911. The cardboard tray has a rectangular outline. The cut-outs for the beaker packs are arranged in rows parallel to the longitudinal edge and to the transverse edge of the cardboard tray. The cardboard tray thus requires a corresponding material blank and also a corresponding stacking and transportation space on the pallets for handling the beaker packs in the incubation chambers and cooling chambers and during transportation.

SUMMARY OF THE INVENTION

The object of the invention is to reduce the consumption of materials and to utilize better the space within a stack, as well as to improve the functional value of the cardboard trays.

This object is achieved according to the invention in that adjacent longitudinal rows of the receivers are displaced relative to one another, in that the transverse edges of the base section follow a meandering line, and in that the base section has cut-in border flanges bent upwards and joined.

The invention differs from the prior art in that the rows of packs within the cardboard tray are displaced relative to one another, so that the packs can be packed more densely on the cardboard tray. This results in a considerable reduction in the consumption of materials for the cardboard tray. In addition, during handling of the packs, in particular during incubation of yogurt formulations, the base section is prevented from sticking or adhering to the lids of a layer of packs underneath. Finally, adjacent cardboard trays can be placed closely side by side and interlinked with their transverse edges, so that not only the space requirement on the pallet but also the cohesion of the stack is improved. The space utilization is thus increased and the space requirement in the incubating chamber and cooling chamber and during transportation is reduced. Corresponding savings in space are also achieved in the case of drink bottles, drink cans, jars or the like.

Beaker packs are mainly referred to below. These are also understood as meaning, however, drinking vessels for drink formulations, cans for drinks, preserves and other foodstuffs, or jars and other articles.

For centering and holding the beaker packs to be accommodated, the invention proposes that the receivers are constructed as cleanly cut, upright attachments of the base section.

In another embodiment, it is proposed for centering that the receivers are constructed as cut-outs in a top blank which joins the border flanges of the base section to one another. The stabilization of the beaker packs within the receivers achieved in this way also allows the cardboard trays to be placed directly in an inclined sales rack. The beaker packs can then be removed individually, without all the beaker packs becoming disordered when one beaker pack is removed.

A particularly advantageous utilization of space is achieved by the fact that adjacent longitudinal rows are in each case displaced relative to one another by half the separation of the receivers.

So that adjacent cardboard trays can be placed close to one another, it is proposed that the meandering lines of the two transverse edges of a cardboard tray are constructed to match one another in pairs.

To increase the packing density of the beaker packs, it is proposed that the receivers of adjacent longitudinal rows are pushed into one another in the transverse direction. The beaker packs can in this way be accommodated on the cardboard tray in the densest possible arrangement.

To stabilize the base section and for simple production of the cardboard tray, it is proposed that the sections of the border flanges are joined by overlapping joins after being bent upwards. The join is preferably constructed as a glued join.

So that constant stabilization by border flanges is also guaranteed on the meandering transverse edges, the invention provides for border flanges to be cut into the sections of the transverse edges running perpendicular to the longitudinal edges.

By a particular design of the blank, the invention also allows a continuous join of the border flanges to the tuck-in transverse edge, so that a right-edged recess with out-in border flanges is provided on the tuck-in part of the transverse edge and sections of border flanges which overlap the recess are provided on the transverse edge.

BRIEF DESCRIPTION OF THE DRAWINGS

Embodiments of the invention are explained below with reference to the drawings attached, in which.

Figures 1, 2:
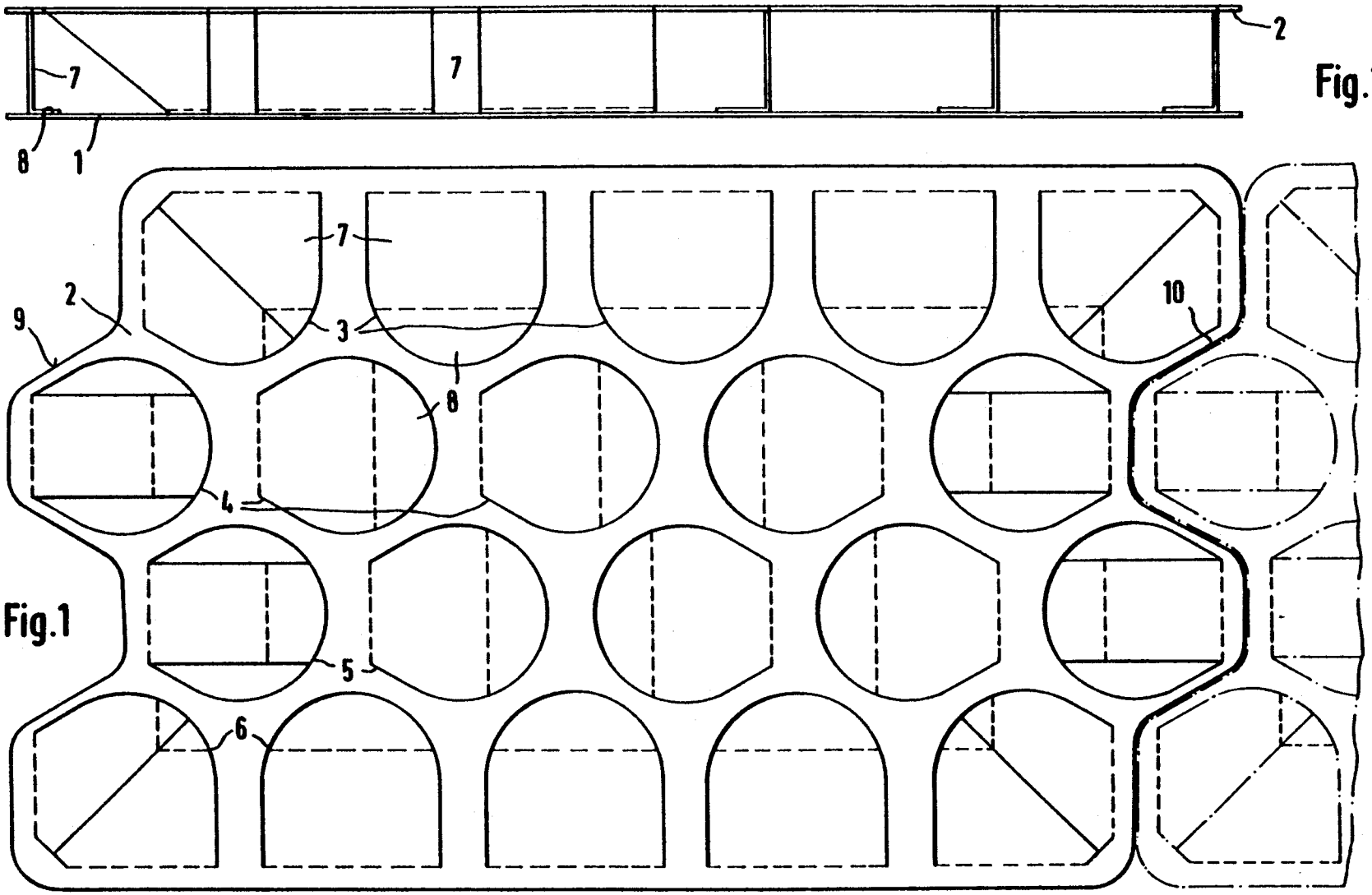
FIG. 1 represents a plan view of a cardboard tray according to the invention.
FIG. 2 represents a side view of FIG. 1.

DETAILED DESCRIPTION OF THE DRAWING FIGURE AND PREFERRED EMBODIMENTS OF THE INVENTION

The cardboard tray according to FIG. 1 and 2 includes two blanks, that is to say a base section 1 and a top blank 2. Both blanks are made of cardboard. The base section 1 is made of corrugated cardboard and the top blank 2 of solid cardboard. This also provides the possibility of constructing the cardboard trays in different ways, in particular in colored form or with an appropriate print.

FIG. 1 shows a plan view of the cardboard tray. The numerous receivers 3, 4, 5, 6 in the form of cut-outs for beaker packs, which are not shown, can be seen in the top blank. In FIG. 1, the outlines of the receivers are drawn in with the particular separating lines and scored folding lines. After bending, parts of the clean cuts serve as support legs 7 and corresponding sections serve as adhesive feet 8, which are stuck onto the base section, as can be seen from FIG. 2. According to the diagram in FIG. 1 and 2, the support legs 7 are arranged in different directions, that is to say in some cases parallel to the longitudinal edges and in some cases parallel to the transverse edges, in order to increase the stability of the cardboard tray in this way. The figures show a cardboard tray for 5×4 beaker packs. A cardboard tray for 4×3 beaker packs can be constructed correspondingly.

The receivers 3 and the receivers 4 of adjacent longitudinal rows are displaced relative to one another in the longitudinal direction by half the separation of the centers of the receivers. In the transverse direction, the receivers of adjacent longitudinal rows are partly pushed into one another, that is to say the separation of the joining lines of the receivers of adjacent longitudinal rows is smaller than the separation of the center of two receivers within one longitudinal row. This results in a particularly dense arrangement of the receivers and therefore a dense arrangement of the beaker packs on the cardboard tray. The transverse edges are constructed as meandering lines 9, the meandering lines 9 and 10 of the right-hand and left-hand transverse edge matching one another in pairs, so that the longitudinal edges of adjacent cardboard trays can be pushed into one another in a positive fit, as is shown in the right-hand part of FIG. 1. Mutual interlocking and stabilization of the cardboard trays within the stack on a transportation pallet is obtained in this way.

A considerable saving in materials is achieved according to the invention, since the receivers are crowded together and the packing density of the beaker packs is increased. The space requirement within the stack of cardboard trays is also reduced. Five cardboard trays according to the invention can be arranged side by side on a customary standard pallet by using the invention, compared with four cardboard trays according to the prior art. This means an increase in space utilization of 25 per cent. A further increase in space utilization results by the mutual displacement and interconnection. The space requirement within the incubating chamber and the cooling chamber and the transportation requirement needed are thus also reduced. This increases the profitability of the cardboard tray according to the invention to an exceptional degree. The different choice of material for the base section and the top blank allows adaptation to the necessary loads and prevents adhesion or sticking of the top blank to the lid of beaker packs in a layer underneath. By using corrugated cardboard for the base section and by the interlocking at the transverse edges of adjacent cardboard trays, a considerably higher stability and rigidity of the stack of cardboard trays on a pallet is achieved. The arrangement of the support feet in different alignments results in an improved aeration of the pallet.

Figure 3:
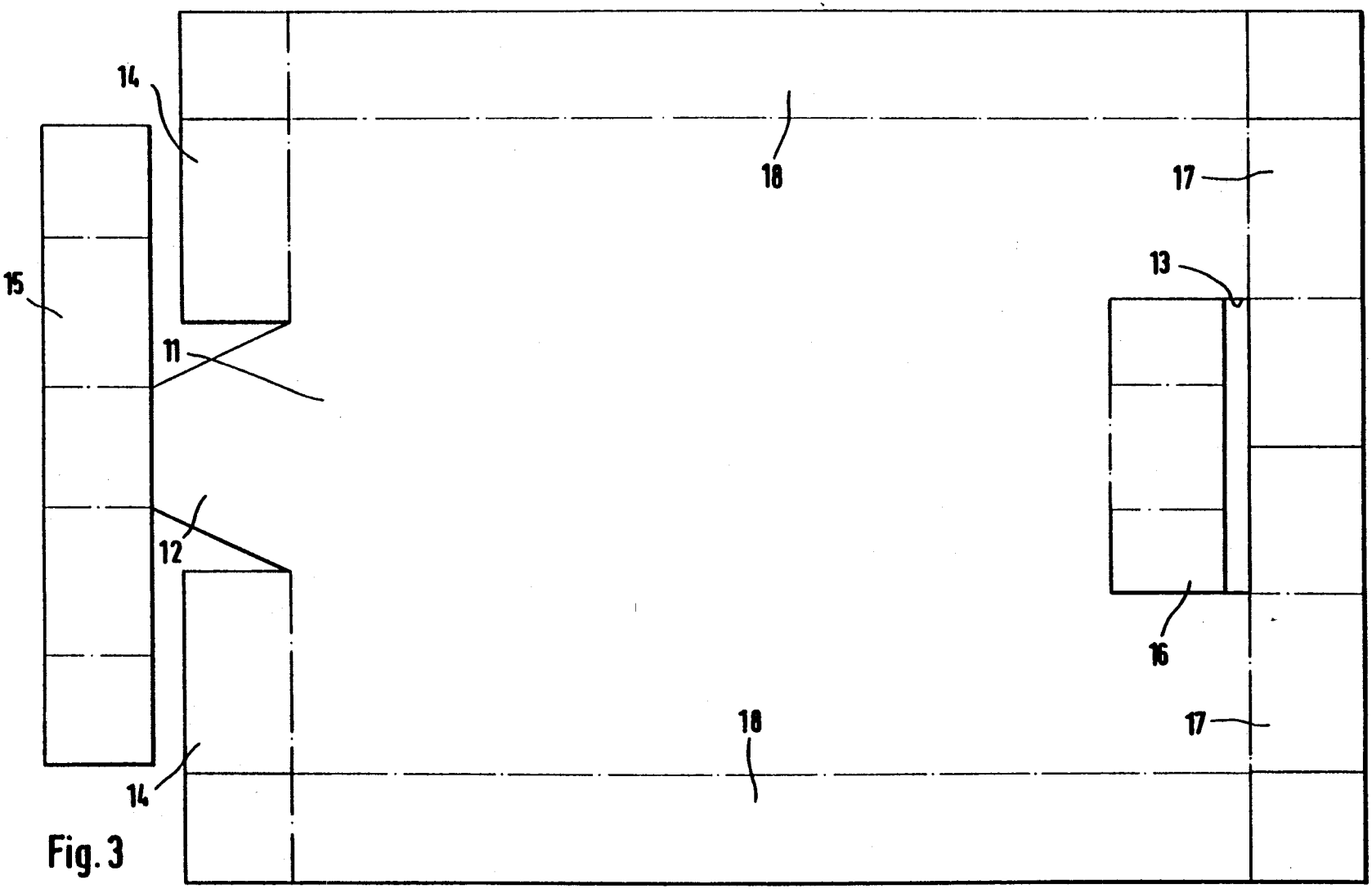
FIG. 3 represents a developed view of a blank.

According to the invention, a cardboard tray comprising a base section with surrounding border flanges can also be provided. FIG. 3 shows the developed view of a corresponding blank. The base section 11 has a trapezoidal attachment 12 on one transverse edge. A right-edged recess 13 is provided on the opposite transverse edge. Sections 14, 15, 16, 17 of border flanges 19 sit in each case on the transverse edges running parallel to the longitudinal edges. These sections are in some cases cut cleanly and scored. Border flanges 18 are also cut in on the longitudinal edges. The border flanges are erected vertically and folded in accordance with the edge lines of the transverse edges. This can be seen from FIG. 4, which shows the base section 11 with surrounding border flanges 18 and 19. After erection, sections 14 to 17 are folded to overlap and are glued to one another. An exceptionally stable construction of the base section is obtained in this way.

Figures 4, 5:
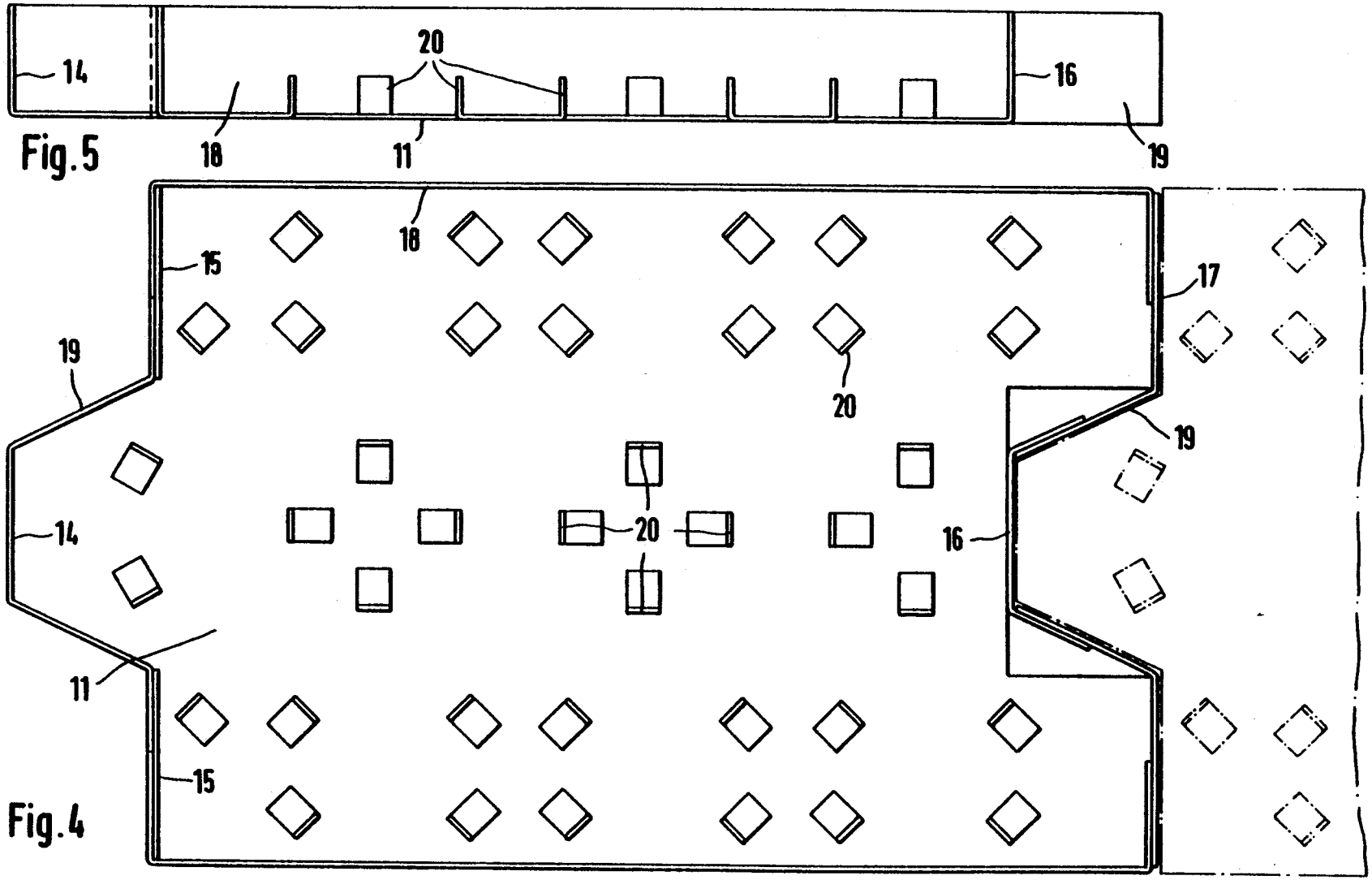
FIG. 4 represents a cardboard tray, with receivers, formed from this blank, in plan view.
FIG. 5 represents a section of FIG. 4.

Receivers are constructed in each case in three longitudinal rows by cleanly cut, upright flap-like attachments 20. These attachments 20 match the base of the particular beaker pack and allow longitudinal rows of beaker packs to be installed. The cardboard tray according to FIG. 3 to 5 is constructed for three rows of 4 beaker packs each. Here also, the same saving in space is achieved within the cardboard tray. This cardboard tray can be placed in a sales rack in an inclined position. The beaker packs can easily be removed individually, without the remaining beaker packs becoming disordered.

Figure 6:
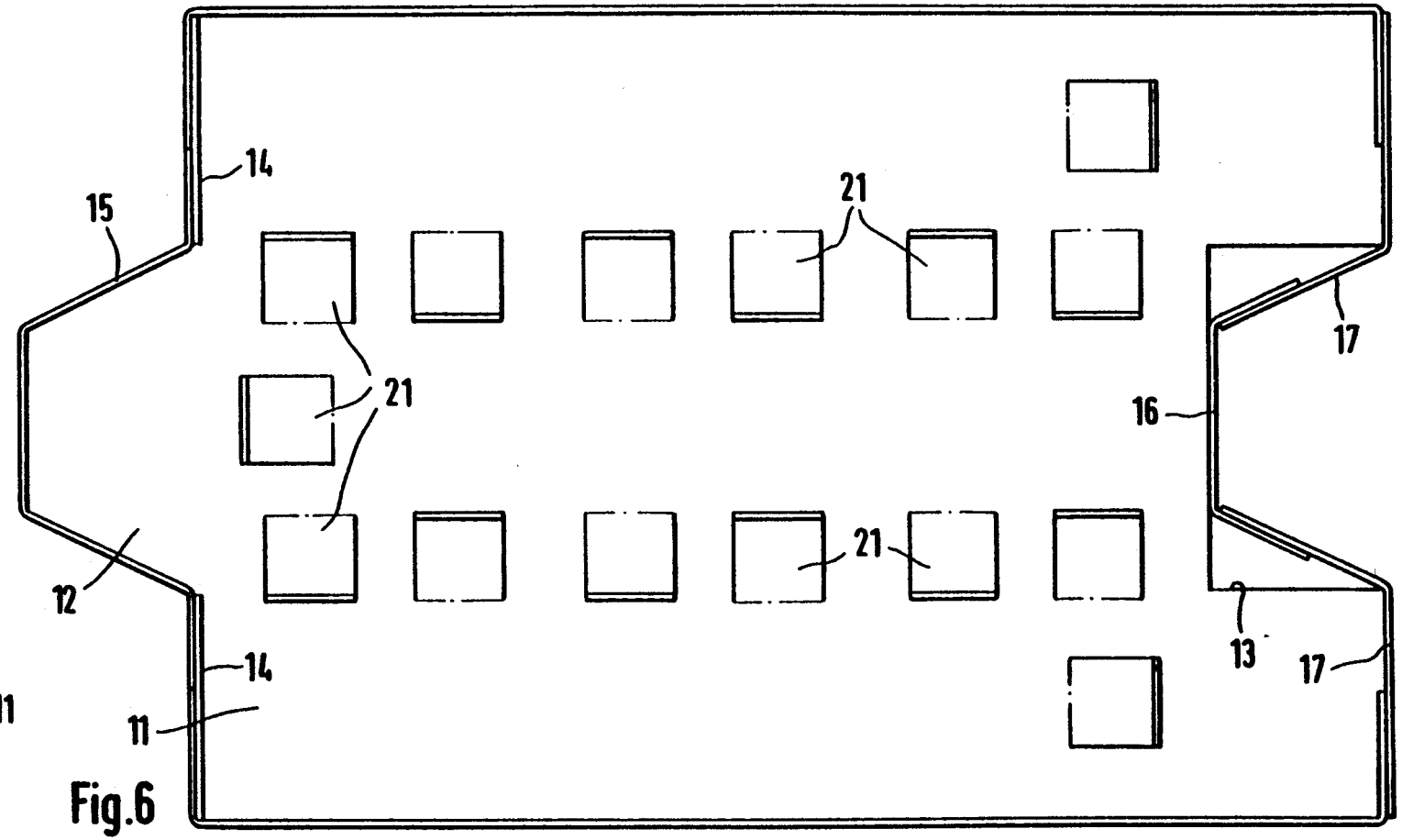
FIG. 6 represents a plan view of a modified cardboard tray.
Figure 7:
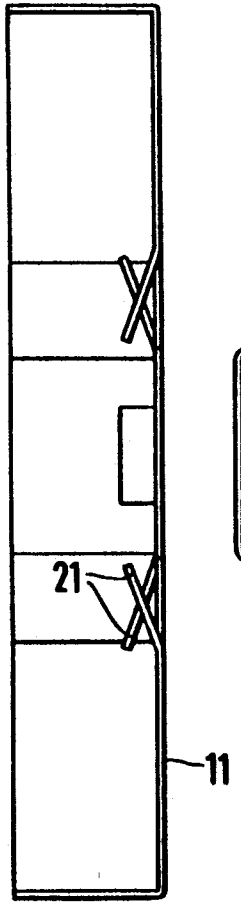
FIG. 7 represents a folded-over version of FIG. 6.

A modified embodiment of a cardboard tray is shown in FIG. 6 and 7. This differs from the embodiment described above by the attachments 21 for the receivers. In this case, the attachments are constructed as cleanly cut, angled flanges, as can be seen in particular from FIG. 7. This arrangement of the cut-out is completely adequate for centering and holding the beaker packs.

Figure 9:
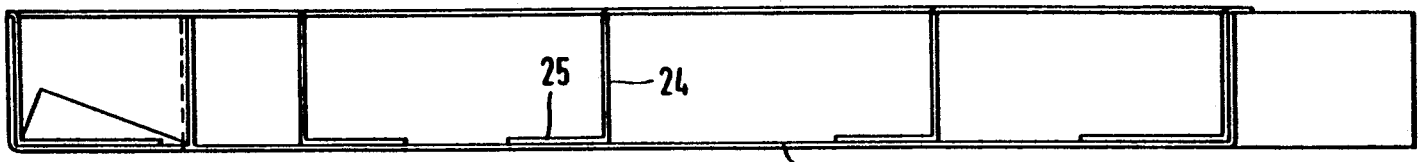
FIG. 8 represents a plan view of another embodiment of a cardboard tray and FIG. 9 represents a folded-over version of FIG. 8.
Figure 8:
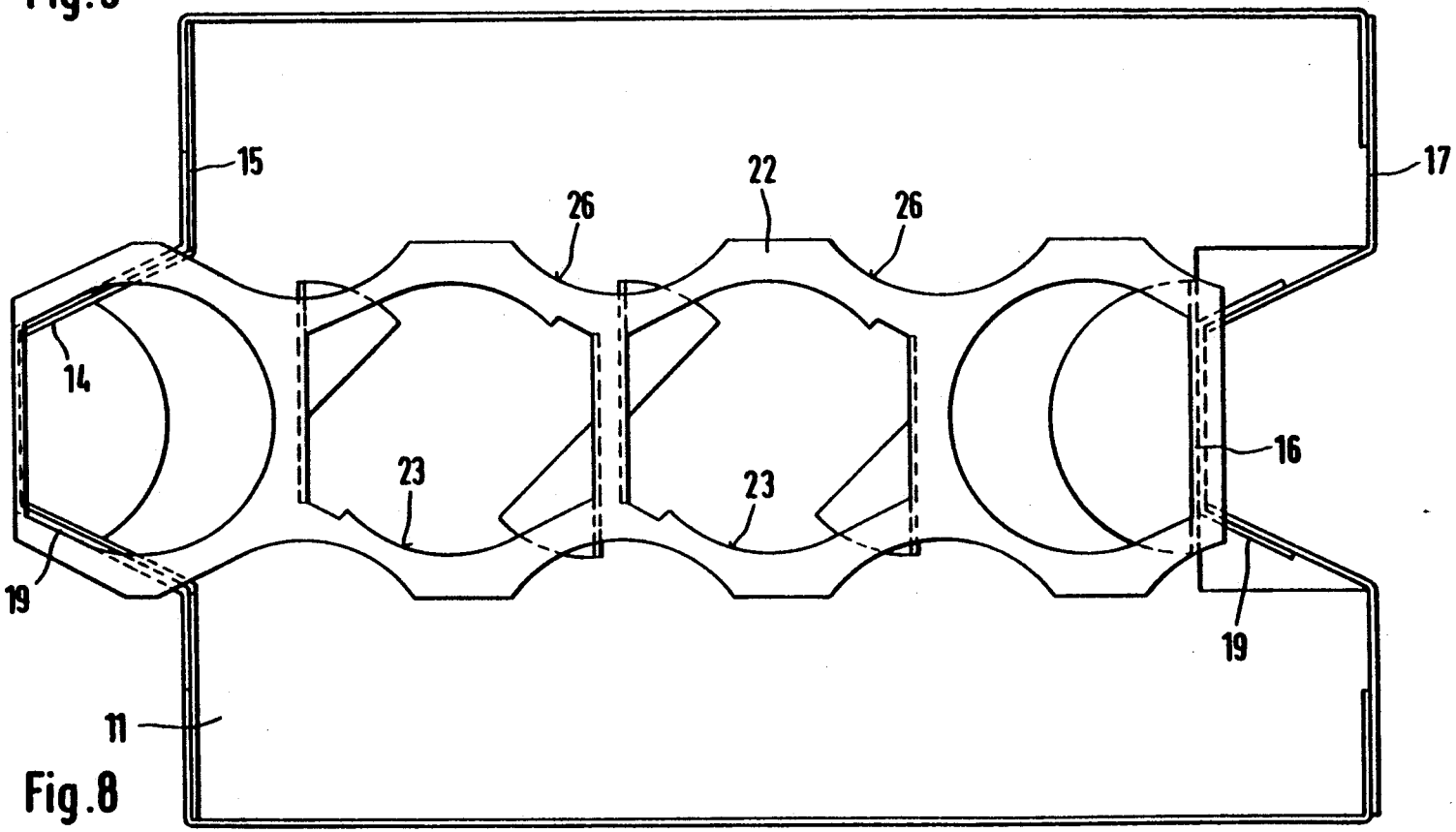

A further modification of the invention, according to FIG. 8 and 9, provides a top blank 22 which joins opposite border flanges 19 of the cardboard tray. The top blank has cut-outs 23 as receivers. Support feet 24 are cleanly out and bent over in the cut-outs 23. The support feet are glued to bent-over flaps on the base wall. The outer edges of the top blank 22 have recesses 26 corresponding to the shape of the beaker packs, so that the outer rows of beaker packs are also centered by the top blank 22.

I claim:

1. A cardboard tray for cylindrical packs, comprising:

a base section having longitudinal edges and transverse edges; and, receivers aligned in longitudinal rows for retaining longitudinal rows of cylindrical packs, said receivers being arranged parallel to the longitudinal edges of said base section, with adjacent longitudinal rows of said receivers being displaced relative to one another, and said base section having cut-in border flanges, said cut-in border flanges having transverse border flanges at each of said transverse edges with said transverse border flanges at each of said transverse edges being bent up and joined in a meandering configuration.

2. The cardboard tray for cylindrical packs according to claim 1, wherein said receivers are constructed as cleanly cut, upright attachments of said base section.

3. The cardboard tray for cylindrical packs according to claim 1, wherein said receivers are constructed as cutouts in a top bank, which joins the cut-in border flanges of said base section to one another.

4. The cardboard tray for cylindrical packs according to claim 3, wherein the adjacent longitudinal rows of said receivers are displaced relative to one another in a case by half of the separation of said receivers from one another.

5. The cardboard tray for cylindrical packs according to claim 1, wherein the adjacent longitudinal rows of said receivers are displaced relative to one another in a case by half of the separation of said receivers from one another.

6. The cardboard tray for cylindrical packs according to claim 1, wherein the cut-outs of the adjacent longitudinal rows of said receivers are pushed inward toward one another in a traverse direction.

7. The cardboard tray for cylindrical packs according to claim 1, wherein the cut-in border flanges of said base section are comprised of four sections which are joined together by overlapping joins after being bent up.

8. The cardboard tray for cylindrical packs according to claim 1, wherein said traverse edge of said base section of said cardboard tray forms said meandering line which complements the traverse edge of the base section of an adjacent cardboard tray.

9. The cardboard tray for cylindrical packs according to claim 10, wherein said traverse edge of said base section having a cut-in section has a right-edged recess with said sections of said border flange overlapping said right-edged recess.

* * * * *